United States Patent [19]

Dugas

[11] Patent Number: 4,805,250

[45] Date of Patent: Feb. 21, 1989

[54] BLADE PICK AND WELL CLEANER

[76] Inventor: Theodore F. Dugas, Box 6616, Fort Lauderdale, Fla. 33316

[21] Appl. No.: 101,859

[22] Filed: Sep. 25, 1987

[51] Int. Cl.[4] ..... B26B 11/00

[52] U.S. Cl. ..... 7/118; 30/155

[58] Field of Search ..... 7/118; 30/155, 158

[56] References Cited

U.S. PATENT DOCUMENTS

| | | | |
|---|---|---|---|
| 149,806 | 4/1874 | Swan | 7/118 |
| 303,855 | 8/1884 | Hunt | 30/158 X |
| 456,811 | 7/1891 | Gerlach | 7/118 |
| 915,007 | 3/1909 | Wilson | 30/158 |
| 4,095,337 | 6/1978 | Pharr | 30/158 |
| 4,525,928 | 7/1985 | Foster | 30/158 |

*Primary Examiner*—James G. Smith

*Attorney, Agent, or Firm*—Robert A. Miller; Penrose Lucas Albright

[57] ABSTRACT

A tool which functions as a blade pick and well cleaner to be used with "pocket" knives. The blade pick and well cleaner, made of a strong, slightly malleable material, preferably stainless steel, has ends that may be inserted in the notch of knife blades and attachments to assist in their opening when fingers and fingernails are ineffective or inadequate for this purpose. The bottom end of the blade pick also serves as a cleaner to remove the material adhering therein, including that material which made opening the blade or attachment difficult. In the preferred embodiment, the blade pick and well cleaner replaces the toothpick or tweezers that are found in handle slots or receptacles of a specific type of knife known as a "Swiss Army Knife". The tool may also be composed of any one of several permanent magnet materials having sufficient strength, hardness and corrosive assistance properties to serve the purposes of the tool. In such case, the tool need not be bowed and can be retained in place by magnetic attraction. Such a tool also provides the user with an emergency compass.

19 Claims, 1 Drawing Sheet

BLADE PICK AND WELL CLEANER

BACKGROUND OF THE INVENTION

1. Field of Invention

This invention relates to a tool for positively moving a knife blade or attachment from its sheathed position, either wholly or partially, and to clean the well where the knife blade or attachment is sheathed.

2. Related Art

Devices are known which assist the act of extracting knife blades and other devices from the wells in which they are sheathed for carrying safety. The knives to which they apply belong to the generic class of knives normally called penknives or pocket knives wherein the blades and an assortment of other items such as can openers, corkscrews, screwdrivers, files, etc. fold into the handles. The devices to assist in extracting the blade or other item from the sheathed position range from specially designed handles, that encase the blades and attachments, through spurs, notches and holes integrated into knife blades and attachments to receive extraction implements, ranging from fingernails to nail heads. The actual implement to be used to assist in opening, or unsheathing, the blades or other items is not part of the knife, as such. Wilson, U.S. Pat. No. 915,007, discloses a pocket knife and an opening key therefor; however, the key so described is not designed to provide a well cleaning capability.

SUMMARY OF THE INVENTION

In accordance with the present invention there is provided a blade pick and well cleaner that is designed to be used with knives of the type commonly referred to as penknives or pocket knives. It is particularly designed, however, for use with a specific subclass of pocket knives comprising combination knives intended for use by outdoors' people. Such knives may include in addition to longer and shorter knife blades, instruments and items such as spoons, scissors, saws, can and bottle openers, forks, files, gouges, punches, screwdrivers, and corkscrews. The cases for such knives, though commonly made of rust and corrosion resistant metals, are prone to collect materials, such as wood sap, congealed liquids, mud and small organic and inorganic particulates, in the wells where the blades and other attachments are sheathed when not in use. The collection of material in these wells eventually makes opening and closing of blades and attachments difficult as best, and impossible at worst, if the user must rely upon his or her fingers and fingernails.

The invention provides the user a device to be used in cooperation with the notch normally provided in the knife blades and attachments to assist the user to open the blades and attachments. The invention also confers the ability to clean the wells rapidly, when the knife blades or attachments are in an open position, thereby permitting the blades or attachments to be closed completely or more easily opened by use of the fingers alone.

In a particular brand of knives, known as "Swiss Army Knives", and knives having similar characteristics, the invention can be stored in slots or receptacles provided in the casings which ordinarily contain items such as tweezers or toothpicks. Such items, however, are constructed of softer or weaker metals or other materials than the invention and therefore are of little or no value for purposes served by the invention as well as for other uses to which the invention may be put. Such collateral uses include the untying or loosening of knots, prying up handles on pop top cans, and tops from canned foods; common activities of outdoors' people for which a small, strong, blunt instrument is desirable. It also can function as a pipe cleaner and tamper.

DESCRIPTION OF THE PREFERRED EMBODIMENT

Figure 1:
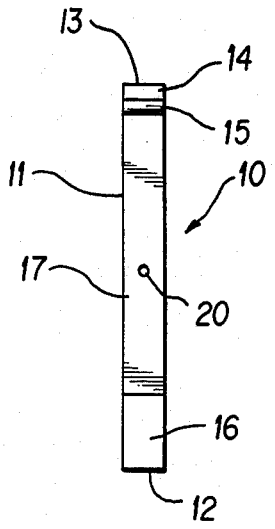
FIG. 1 is a front elevational view of the invention.

Referring now to the drawings, numerals are used to indicate aspects of the invention and capital letters are used to indicate parts of a knife to which the invention is related and for which it is intended in the preferred embodiment.

FIG. 1 depicts the tool 10 of the invention which comprises of a shank 11 having a flat bottom end 12. It has a protruding, or top, end 13 which is disposed at a right angle to a shank main body 17 and has a face 14 that is smaller than where protruding end 13 emerges from body 17. Shank main body 17 has a rectangular cross-section throughout, the cross-section being uniform from where the underside 15 of end 13 joins shaft main body 17 to where shank main body begins to taper along surface 16 to end 12. From face 14, an underside 15 of end 13 is angled to provide a larger surface area where end 13 joins at a right angle to the shank main body 17.

Figure 2:
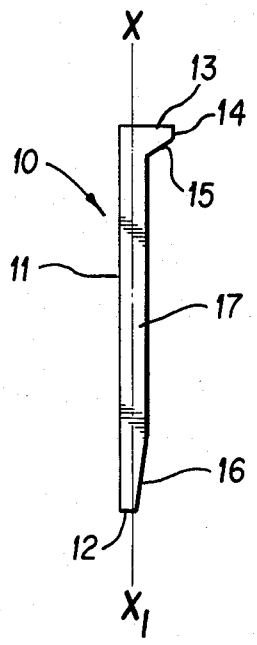
FIG. 2 is a side elevational view of the invention.
Figure 3:
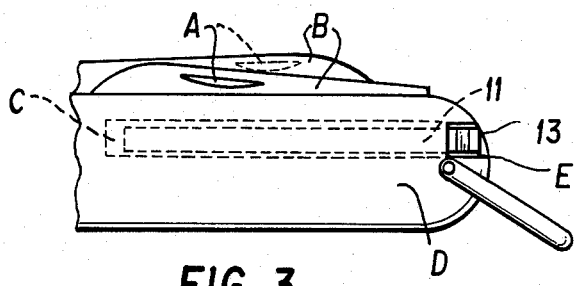
FIG. 3 is a broken side elevated view of a "Swiss Army" type knife with the invention inserted in a knife handle slot or receptacle.
Figure 4:
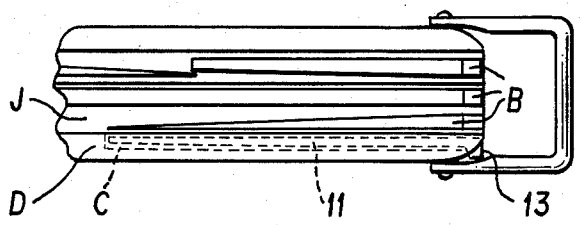
FIG. 4 is a top plan view of a "Swiss Army" type knife with invention inserted in a knife handle slot or receptacle.

From FIG. 2 it can be seen that the lower portion of body 17 tapers along a surface 16 to end 12 so that such end's surface dimensions are the same as face 14. Shank main body 17 is preferable slightly bowed or bent, with respect to its longitudinal axis $x—x_1$. This bowing of shank 11 provides resistance when the invention is inserted into the receptacle or slot C of the knife handle D, as shown in FIGS. 3 and 4. The resulting resistance and friction serves to retain the invention within slot C of knife handle D until physically removed by the user.

The tool 10 of the invention, when extracted from slot C is used to assist in opening the knife blades and attachments by inserting either the bottom end 12 or the protruding end face 14 into the blade or attachment notch A and applying force in a direction that will permit the blades or attachment to open after breaking loose from debris and retaining material. With the blade or attachment in an open position, bottom end 12 may be inserted into the blade or attachment well J and moved up and down the length of the well to scrape and remove material hindering the knife blade or attachment from opening or sheathing.

The tool of the invention is preferably composed of stainless steel such as cold formed A151 type 302 stainless steel (A313) which may also be in a full hard or spring-temper condition. Wrought stainless steel A151 types 301, 304, 305, and 308 may also be used. Where exposure to sea water is likely, forged nickel-copper alloy known as "Monel" is an excellent material for the invention. Materials having permanent magnetic properties such as 36% cobalt steel, the Alnico alloys, Cunico, Cunife, Remalloy, fabricated by casting, sintering or pressing may also be used. In such case, the invention is usually held in position in the knife's slot C by magnetic attraction and need not be slightly bowed to provide the friction for retention. With the invention composed of a permanent magnetic material, it provides additional advantages which include, by providing an opening or hold 20 at the tool's center of gravity, a compass for the user if the tool is appropriately balanced on a pin, pointed object or suspended on a thread or the like at hole 20. Other materials will occur to those skilled in the art.

If desired, a logo can be molded or surface imprinted on the upper side of end 13, or elsewhere on tool 10 or the owner's name or initials or the like can be imprinted, inscribed or etched thereon.

In practice, the overall length of the tool is $1\frac{7}{8}''$, its width is 7/16", and its thickness is 1/16". End 13 is 9/64" across as seen in FIG. 2. Face 12 tapers from 1/32" to 1/16" for $\frac{3}{8}''$ along surface 16. End 13 is outwardly 1/32" thick and diverges downwardly along underside 15 to 1/16" in a lateral distance of 5/64".

Although the preferred embodiment of the present invention has been disclosed and described in detail above, it should be understood that the invention is not necessarily limited thereby, and its scope is to be determined by that of the following claims.

What is claimed is:

1. A tool for opening all blades and attachments of a pocket knife and cleaning debris out of said knife blade and attachment wells which comprises a parallelpiped metal rod having a shank, a first end of said shank adapted to be received in notches for opening said pocket knife's blades and attachments and a second end of said shank for being received in the wells for the blades and attachments of said pocket knife.

2. A tool for opening knife blades and attachments and cleaning knife blade and attachment wells as claimed in claim 1 wherein said second end comprises a square bottom end of said shank and said first end comprises an upper protruding end which is disposed at a right angle to said shank.

3. A tool for opening knife blades and attachments and cleaning knife blade and attachment wells as claimed in claim 2 wherein said shank comprises means for retaining said tool in a slot in said pocket knife.

4. A tool for opening knife blades and attachments and cleaning knife blade and attachment wells as claimed in claim 3 wherein said shank is slightly bowed to be resiliently retained in said slot.

5. A tool for opening knife blades and attachments and cleaning knife blade and attachment wells, as claimed in claim 4 where said shank is composed of stainless steel.

6. A tool for opening knife blades and attachments and cleaning knife blade and attachment wells as claimed in claim 3 wherein said tool is composed of a permanent magnetic material for retention in said slot by magnetic attraction.

7. The combination of a picket knife with a tool for opening blades and other items which fold into the knife's handle, said tool comprising a metal alloy bar having a shank with a polygon cross-section throughout and opposite ends, one of said ends having a flat portion that extends normally to said shank and terminates in a portion adopted to be received in notches in said blades and other items for opening same, the other of said ends being tapered inwardly and so configured that it is adapted to be received in wells for receiving said blades and other items to scrape dirt and other material therefrom, said handle having a slot which is adapted to receive securely said other end and said shank up to said one end for storing and retaining said tool when not in use, so that it is readily removable by being lifted out of said slot by grasping said one end.

8. The combination of claim 7 wherein the cross-section of said shank is rectangular.

9. The combination of claim 7 wherein said shank is slightly bowed.

10. The combination of claim 7 where said tool is composed of a permanent magnetic material.

11. The combination of claim 7 wherein said tool has a centrally located opening at its center of gravity.

12. The combination of claim 7 wherein said tool is composed of stainless steel.

13. A blade pick and well cleaner for use with a Swiss Army type knife having a slot of corresponding size capable of receiving and retaining the blade pick and well cleaner, such blade pick and well cleaner consisting of a body comprising a shank having a longitudinal axis and opposite ends, one of said ends extending generally normally to said axis and terminating in a face which is generally parallel to said axis and has a thickness not greater than about 1/32", the other of said ends terminating in a further face which is generally normally disposed relative to said axis and has a thickness measured normally to said axis not greater than about 1/32", whereby both said faces are adapted to be received in notches on blades of said knife for opening same and to be received in wells of said knife for removing dirt and debris therefrom.

14. A blade pick and well cleaner in accordance with claim 13 wherein said shank has a width of about 7/64" and a width of about 1/16".

15. A blade pick and well cleaner in accordance with claim 14 which has a length of at least 1" and is composed of stainless steel.

16. A blade pick and well cleaner in accordance with claim 15 wherein said shank is adapted to be permanently bowed relative to said axis to provide for its resilient retention in said slot.

17. A blade pick and well cleaner in accordance with claim 13 composed of a permanent magnetic material which has a tensile strength of at least about 50,000 psi.

18. A blade pick and well cleaner in accordance with claim 17 wherein said material is in a sintered condition.

19. A blade and well cleaner in accordance with claim 18 further comprising a hole at its center of gravity.

* * * * *